US005595215A

United States Patent [19]

Wallace et al.

[11] Patent Number: 5,595,215

[45] Date of Patent: Jan. 21, 1997

[54] IMPROVEMENTS IN OR RELATING TO FLUID-FLOW CONTROL VALVES

[75] Inventors: Ian F. Wallace; John Stamford, both of Peterborough, United Kingdom

[73] Assignee: Perkins Limited, Cambridgeshire, United Kingdom

[21] Appl. No.: 448,513

[22] PCT Filed: Nov. 30, 1993

[86] PCT No.: PCT/GB93/02458

§ 371 Date: May 24, 1995

§ 102(e) Date: May 24, 1995

[87] PCT Pub. No.: WO94/12788

PCT Pub. Date: Jun. 9, 1994

[30] Foreign Application Priority Data

Nov. 30, 1992 [GB] United Kingdom ..... 9225005

[51] Int. Cl.[6] ..... F01B 7/07; F01B 7/00

[52] U.S. Cl. ..... 137/554; 239/585.1

[58] Field of Search ..... 137/554; 239/585.1, 239/585.2, 585.3, 585.4

[56] References Cited

U.S. PATENT DOCUMENTS

| | | | |
|---|---|---|---|
| 4,341,241 | 7/1982 | Baker | 137/554 |
| 4,545,530 | 10/1985 | Hofmann et al. | 137/554 X |
| 4,653,720 | 3/1987 | Knapp et al. | 239/585.1 X |
| 4,964,571 | 10/1990 | Taue et al. | 239/585.4 X |
| 5,104,046 | 4/1992 | Sakagami | 239/585.2 X |
| 5,285,969 | 2/1994 | Greiner et al. | 239/585.1 X |

FOREIGN PATENT DOCUMENTS

| | | |
|---|---|---|
| 783263 | 7/1935 | France . |
| 3445721 | 7/1985 | Germany . |
| 2024934 | 1/1980 | United Kingdom . |

*Primary Examiner*—Hoang Nguyen
*Attorney, Agent, or Firm*—Nilles & Nilles, S.C.

[57] ABSTRACT

A fluid flow control valve includes first and second electrically conductive body members separated by an electrically active separation member having electrical resistance. A valve actuation member is slidably located within the second body member, making a sliding electrical contact with the second body member. The valve actuation member can move from a first position spaced from the first body member to a second position electrically connecting the first body member with the second body member, thus forming a low resistance electrical connection. In its first position spaced from the first body member, the resistance of the electrical connection between the body members depends on the electrical resistance of the separation member. An electrical circuit, connected across the body and members including a current limiting resistor, forms a voltage splitter circuit with the separation member to enable an output voltage signal indicative of contact of the valve actuation member with the first body member to be obtained.

16 Claims, 5 Drawing Sheets

IMPROVEMENTS IN OR RELATING TO FLUID-FLOW CONTROL VALVES

BACKGROUND OF THE INVENTION

The present invention relates in general to fluid-flow control valves, but particularly to fuel injectors for internal combustion (i.c.) engines.

A fuel injector for an i.c. engine normally consists of a valve which, in use, allows fuel to be injected under pressure into a cylinder for combustion. The timing of fuel injection into a cylinder can be reasonably accurately controlled by mechanical means but normally, in the case of a multi-cylinder i.c. engine, the mechanical means does not allow for separate adjustment of fuel injection timing for any one of said cylinders.

Electronic management systems for i.c. engines are now known wherein fuel injection to each cylinder is electronically controlled according to predetermined sequences. Such systems can include sensing means for feeding back to the management system signals indicative of engine timing events which allows the system to separately adjust subsequent timing events for fuel injection into each cylinder according to pre-programmed processes.

Whilst such management systems have been shown to improve engine performance regarding fuel consumption and exhaust emissions, for example, the ability of the system to improve engine performance relates directly to the accuracy of the system's control of timing events which itself depends upon the accuracy of the information the system receives regarding actual timing of fuel injection into each cylinder.

SUMMARY OF THE INVENTION

An object of the present invention is to provide an improved fluid-flow control valve including means to allow timing of fluid-flow to be accurately measured.

According to a first aspect of the present invention there is provided a fluid-flow control valve comprising juxtaposed first and second electrically conductive, stationary body members, separated by an electrically active means having electrical resistance, and an electrically conductive valve actuation member movably mounted to and electrically contacting said second body member, wherein movement of the actuation member from a first position spaced from said first body member to a second position contacting said first body member completes a lower resistance electrical connection between said first and second body members than that already existing through said electrically active separation means.

Preferably, the body members each include electrical contact means for enabling connection thereof to an external electrical circuit.

Preferably also, the valve is closed when the valve actuation member is in its first position. and an electrically conductive valve actuation member movably mounted to and electrically contacting said second body member, said valve actuation member being movable from a first position spaced from said first body member to a second position contacting said first body member, wherein said separating means is electrically conductive but has electrical resistance such that movement of the actuation member from its first position to its second position completes a lower resistance electrical connection between said first and second body members than that already existing between said members through said separation means.

Preferably, the body members each include electrical contact means for enabling connection thereof to an external electrical circuit.

Preferably also, the valve is closed when the valve actuation member is in its first position.

Preferably further, the first body member includes means for normally biasing the valve actuation member in its first position wherein an electrical contact between the biasing means and the valve actuating member has electrical resistance greater than or equal to the electrical resistance of the electrically active separation means.

According to a second aspect of the present invention there is provided a fuel injector nozzle assembly comprising an electrically conductive injector body mounting an electrically conductive injector nozzle, said nozzle being separated from the body by an electrically active means having electrical resistance, an electrically conductive needle valve member slidably locates within the injector nozzle so as to be electrically connected therewith, the needle member being spaced from the injector body in a first position, and contacting the injector body in a second position to complete, when in said second position, a lower resistance electrical connection between the body and the nozzle than that already existing between the body and the nozzle through the electrically active separation means.

Preferably, the injector body and injector nozzle each include electrical contact means for enabling connection thereof to an external electrical circuit.

Preferably, also, the injector nozzle is closed when the needle valve member is in its first position.

Preferably further, the injector body includes means for normally biasing the needle valve member in its first position wherein an electrical contact between the biasing means and needle valve member has electrical resistance greater than or equal to the electrical resistance of the electrically active separation means.

Movement of the needle valve member from its first position to its second position may be by electro-mechanical means such as a solenoid.

Alternatively, movement of the needle valve member from its first position to its second position may be caused by fuel pressure acting on the needle valve member on passage of fuel through the nozzle assembly.

Preferably, the injector body and nozzle are connected to an electrical circuit including a processing means, power supply and a current limiting resistor.

The resistance ($R_1$) of the separation means may be chosen such that a voltage ($V_S$) detected across the current limiting resistor ($R_3$) when the needle valve member is in its first position is less than the threshold voltage ($V_T$) of the processing means.

Alternatively, the resistance $R_1$ of the separation means may be chosen such that a voltage $V_S$ detected across the current limiting resistor $R_3$ when the needle valve is in its first position is greater than or equal to the threshold voltage $V_T$.

BRIEF DESCRIPTION OF THE DRAWINGS

The foregoing and further features of the present invention will be more readily understood from the following description of preferred embodiments, by way of example thereof, with reference to the accompanying drawings, of which.

DESCRIPTION OF THE PREFERRED EMBODIMENTS

Figure 1:
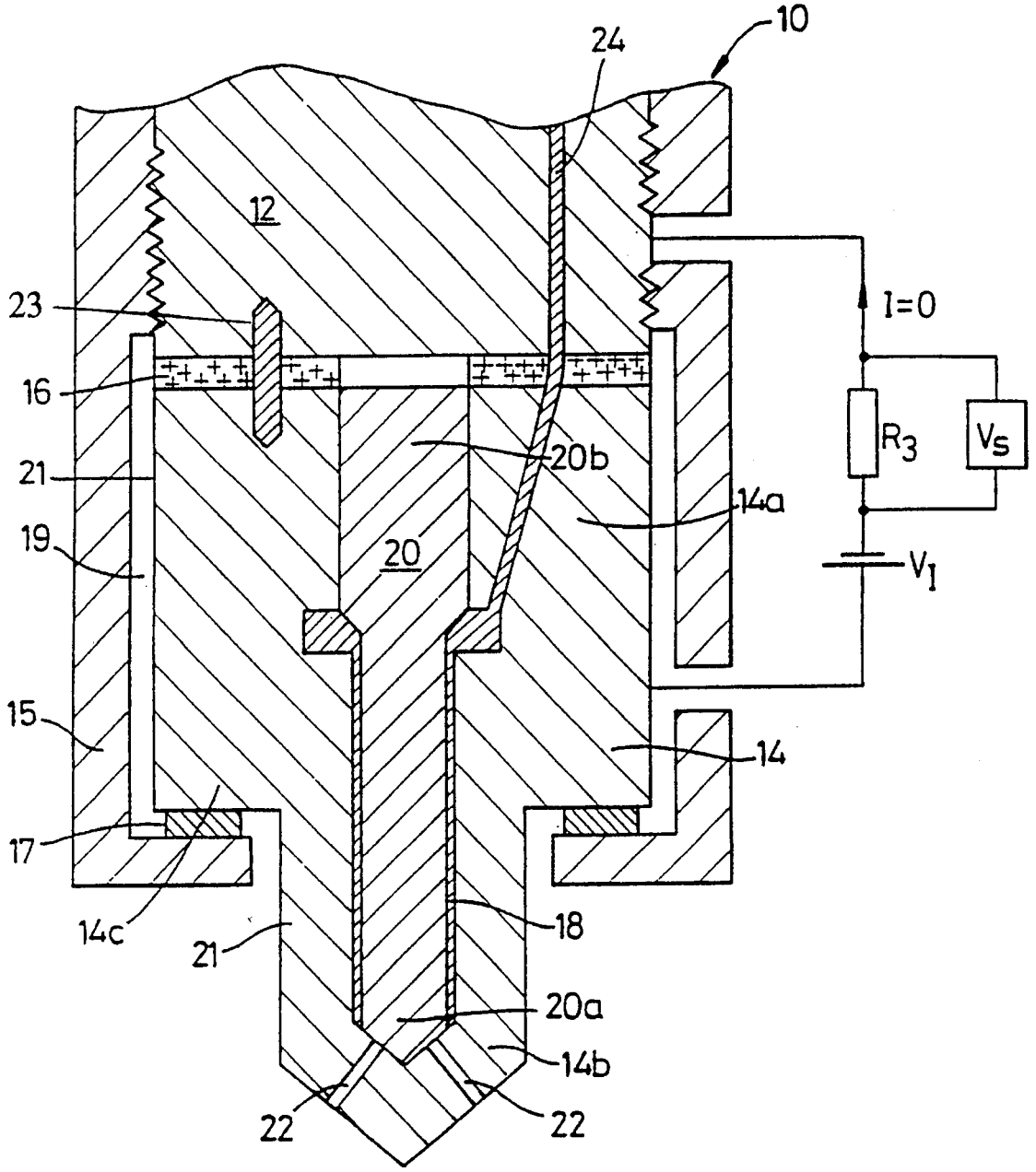
FIG. 1 is a sectional elevation of a first embodiment of a fuel injector nozzle assembly according to the invention showing a needle valve member in a closed position.

Referring to the drawings, FIG. 1 shows a sectional elevation of a fuel injector nozzle assembly 10 particularly suited for use in a diesel-fueled i.c. engine. The fuel injector nozzle assembly 10 consists of an injector body 12 to which is mounted a fuel injector nozzle 14. The injector body 12 and fuel nozzle 14 are both electrically conductive but the injector nozzle 14 is separated from the injector body 12 by a separation an electrically active means 16 having electrical resistance. The injector nozzle 14 has an axially extending bore 18 within which a needle valve member 20 is slidably located. The needle valve member 20 is shown in a first closed position wherein a lower end 20*a* thereof abuts a valve seat portion 14*b* of the nozzle 14 thereby closing two injector apertures 22 which, in use, communicate with the axial bore 18. The needle valve member 20 is also electrically conductive and an upper portion 20*b* thereof makes a sliding electrical contact with the nozzle 14.

The injector body 12 and injector nozzle 14 are held together in compression by a housing 15 (shown only in FIG. 1) which screw-threadedly engages with the injector body 12. The housing 15 contacts a shoulder portion 14*c* of the nozzle body 14 but is separated therefrom by an electrically insulating washer 17. The internal diameter of the housing 15 is greater than the external diameter of the nozzle body 14 such that the housing 15 is separated from the nozzle body 14 by an air gap 19 which also acts to electrically insulate the housing 15 from the nozzle body 14.

The surface of the fuel nozzle 14 may have an electrically insulating layer 21 (shown only on one side of the nozzle 14 in FIG. 1) applied to some of its external surfaces. This layer may be in addition to or substitution for the air gap 19 and/or washer 17. The layer 21 may, in fact, not be electrically insulating but may have similar electrical resistance characteristics to the separation means 16, although the resistance of this layer 21 must be at least equal, if not greater, than the resistance of the separation means. The layer 21 may be spray coated onto the surface of the nozzle 14.

A dowel member 23 (also shown only in FIG. 1) extending into the injector body 12 and fuel nozzle 14 through the separation means 16 prevents the injector body 12 and fuel nozzle 14 from relative rotational movement, particularly when the housing 16 is being screwed onto the injector body 12 to hold said body 12 and nozzle 14 in compression. The dowel member 23 may be formed from an electrically insulating material. Alternatively, the dowel member 23 may have similar electrical resistance characteristics to the separation means 16, but its electrical resistance must be such that it forms an electrical connection between the injector body 12 and fuel nozzle 14 of equal to, or greater than electrical resistance than the separation means 16. The electrical resistance characteristics of the dowel member 23 may be determined by the material from which it is formed. Alternatively, the dowel member 23 may have a suitable electrically resistant coating applied to its surface.

A fuel passageway 24 extending through the injector body 12, separation means 16 and an upper portion 14*a* of the injector nozzle 14 communicates with the axial bore 18 at a position below the upper portion 20*b* of the needle valve member 20. Fuel can be supplied along this passageway for injection into a cylinder (not shown) upon which the fuel injector nozzle assembly 10 is mounted. The lower portion 20*a* of the needle valve member 20 is narrower in diameter than the axial bore 18 thus forming, between the needle valve member 20 and injector nozzle 14, a passageway for fuel to flow through which is annular in transverse cross-section.

When in its first position, as shown in FIG. 1, the needle valve member 20 closes the apertures 22 and prevents fuel injection therethrough.

Figure 2:
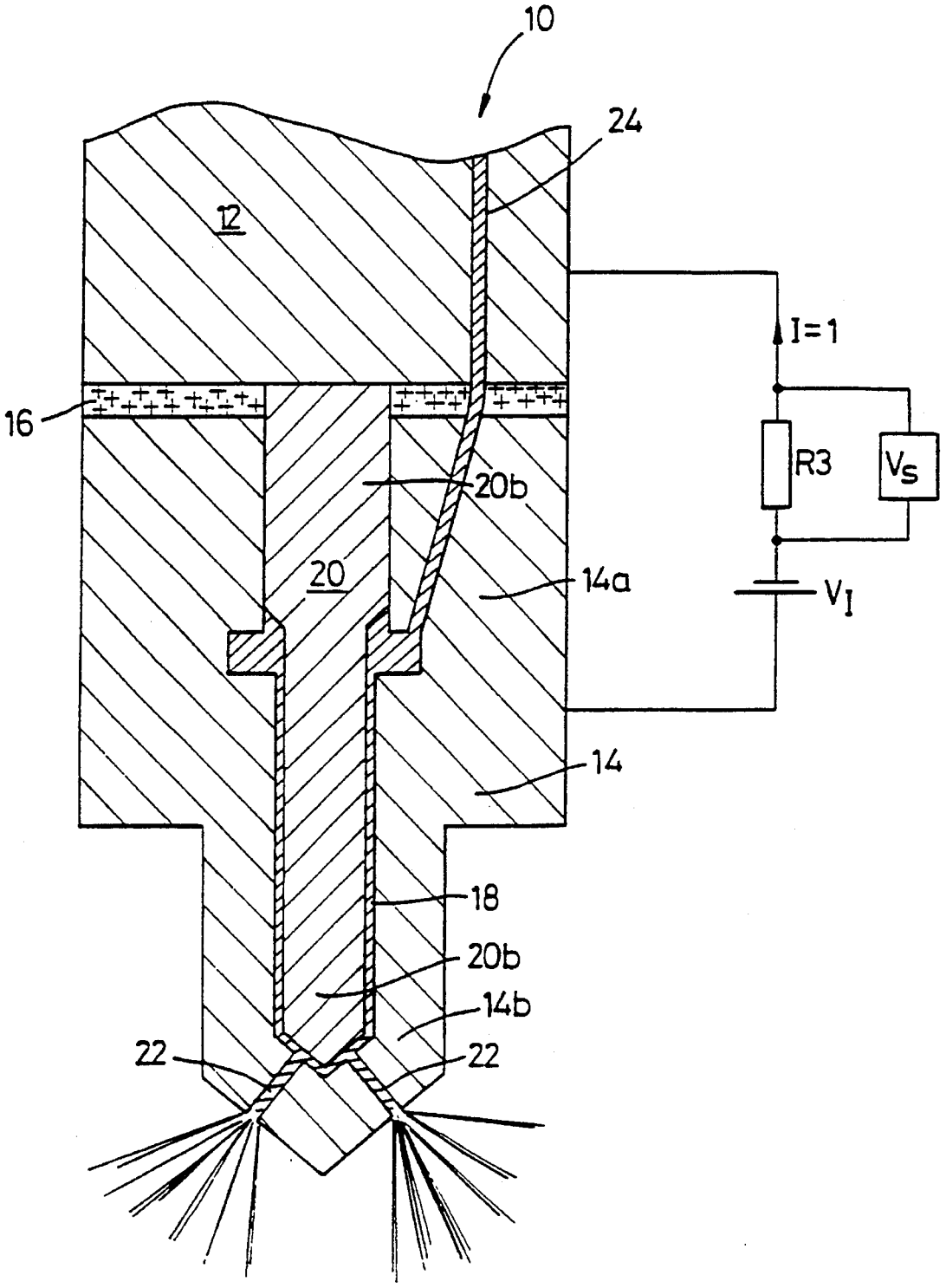
FIG. 2 is a sectional elevation of the fuel injector nozzle assembly of FIG. 1 showing the needle valve member in an open position.

Referring to FIG. 2, the needle valve member 20 is shown in its second position wherein fuel is allowed to pass through the passageway 24 along the axial bore 18 to be injected out of the apertures 22. In its second position, the needle valve member 20 contacts with the injector body 12 thus forming a lower resistance electrical connection between the injector body 12 and fuel nozzle 14 than that already existing between said body and nozzle through the electrically active separation means 16.

Movement of the needle valve member 20 from its first position to its second position may be under the action of a solenoid (not shown). However, in the preferred embodiment of the invention, movement of the needle valve member is caused by the high pressure of the fuel passing down the passageway 24. The fuel pressure is extremely high and causes the valve member 20 to rapidly move from its first position to its second position.

Supply of fuel to the fuel passageway 24 may be by means of an electronically controlled solenoid (not shown) which, once charged, releases fuel during discharge to the passageway 24. The degree of charging of the solenoid determines the volume of fuel injected by the injector assembly 10 to an i.c. engine cylinder.

Figure 3:
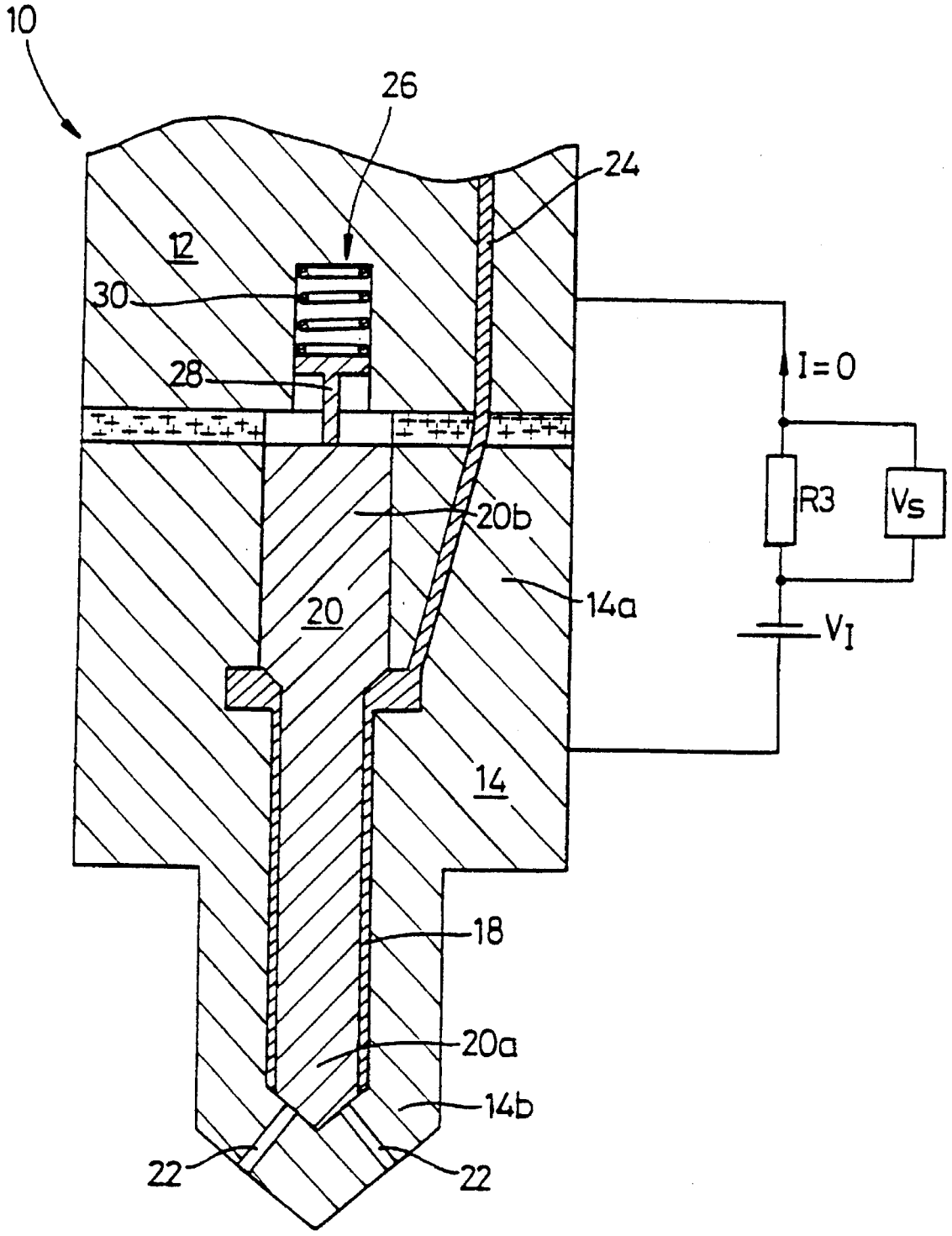
FIG. 3 is a sectional elevation view of a second embodiment of a fuel injector nozzle assembly according to the invention showing a needle valve member in a closed position.

FIG. 3 shows a second embodiment of the invention with the needle valve member 20 shown in its first closed position. The injector assembly 10 of this figure differs only from that shown in FIG. 1 in that it includes biasing means 26 which normally maintains the needle valve member 20 in said first position. The biasing means 26 may simply consist of a plunger 28 and a spring 30 which, in compression, urges the plunger onto the needle valve member 20 thereby urging it towards its first position.

The plunger 28 may be formed from an electrically insulating material. Alternatively, the plunger may have similar electrical resistance characteristics to the separation means 16 but its electrical resistance must be such that it forms an electrical connection with the needle valve member 20 of greater or equal resistance to that of the separation means 16.

Figure 4:
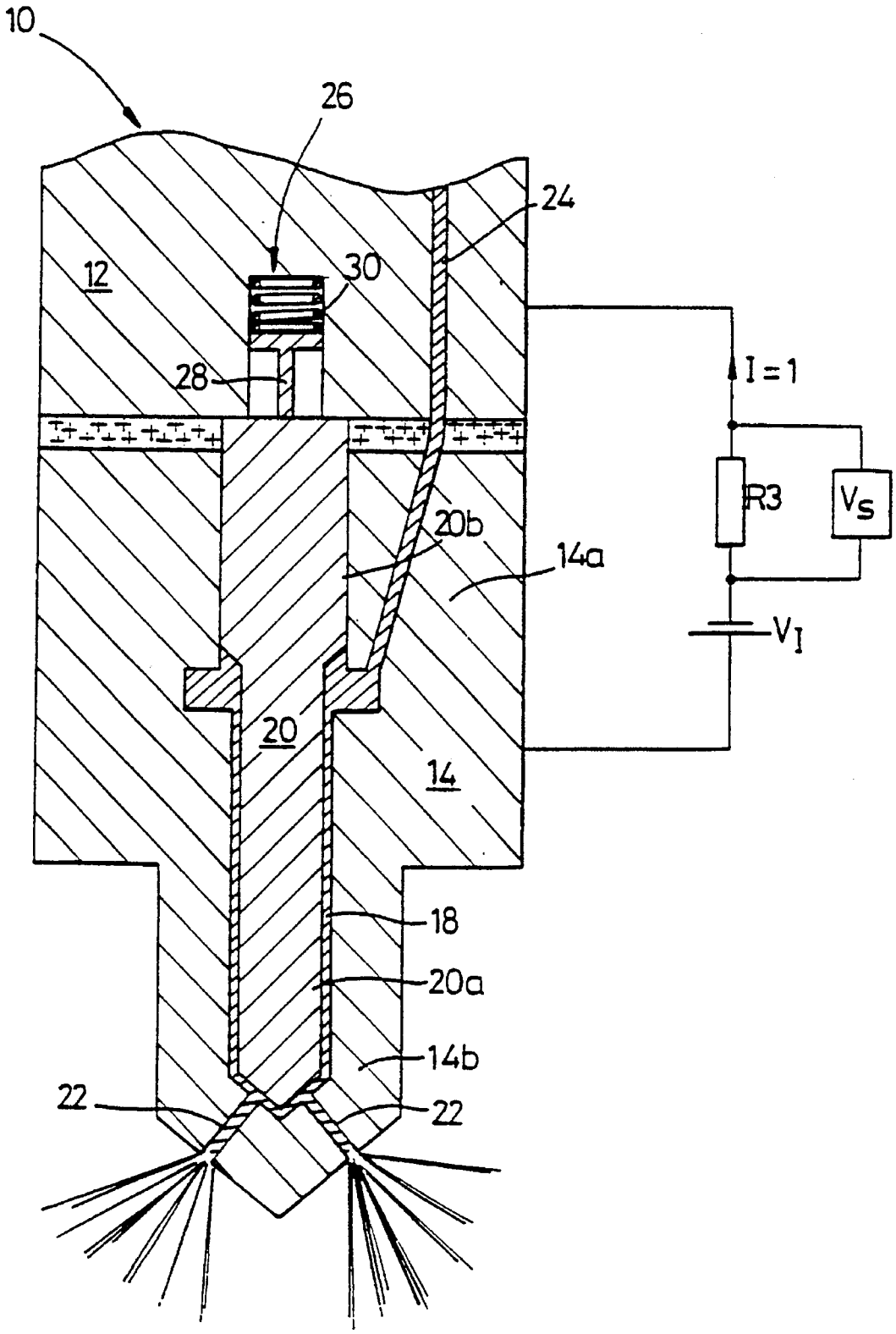
FIG. 4 is a sectional elevation of the fuel injector nozzle assembly of FIG. 3 showing the needle valve member in an open position.

FIG. 4 also shows the second embodiment of the invention but with the needle valve member in its second open position.

An external electrical circuit comprising a power supply $V_I$, a current limiting resistor $R_3$ and a voltage detection means $V_S$ may be connected between the injector body 12 and fuel nozzle 14. The current limiting resistor $R_3$ is chosen to limit current flow through the nozzle body 12 and fuel injector 14 via the needle valve 20 when the needle valve 20 is its second position. The external circuit therefore provides a voltage signal $V_S$ which at least provides data concerning the timing of when the needle valve member is in its second position in contact with the injector body 12. The resistance of the electrical connection formed between the injector body 12 and fuel nozzle 14 via the needle valve member 20 is relatively small compared to the resistance chosen for the current limiting resistor $R_3$ and the resistance $R_1$ of the separation means 16.

It is not necessary to completely electrically insulate the nozzle body 12 from the injector nozzle 14 and the voltage signal $V_S$ indicative of electrical connection between said body 12 and nozzle 14 can be used in a processor means or processor such as an electronic control unit (ECU). Such processing means operate between low state and high state voltages having a threshold voltage ($V_T$) only slightly less than the high state voltage. The low and high state voltages set the logic levels for the processor.

Figure 5:
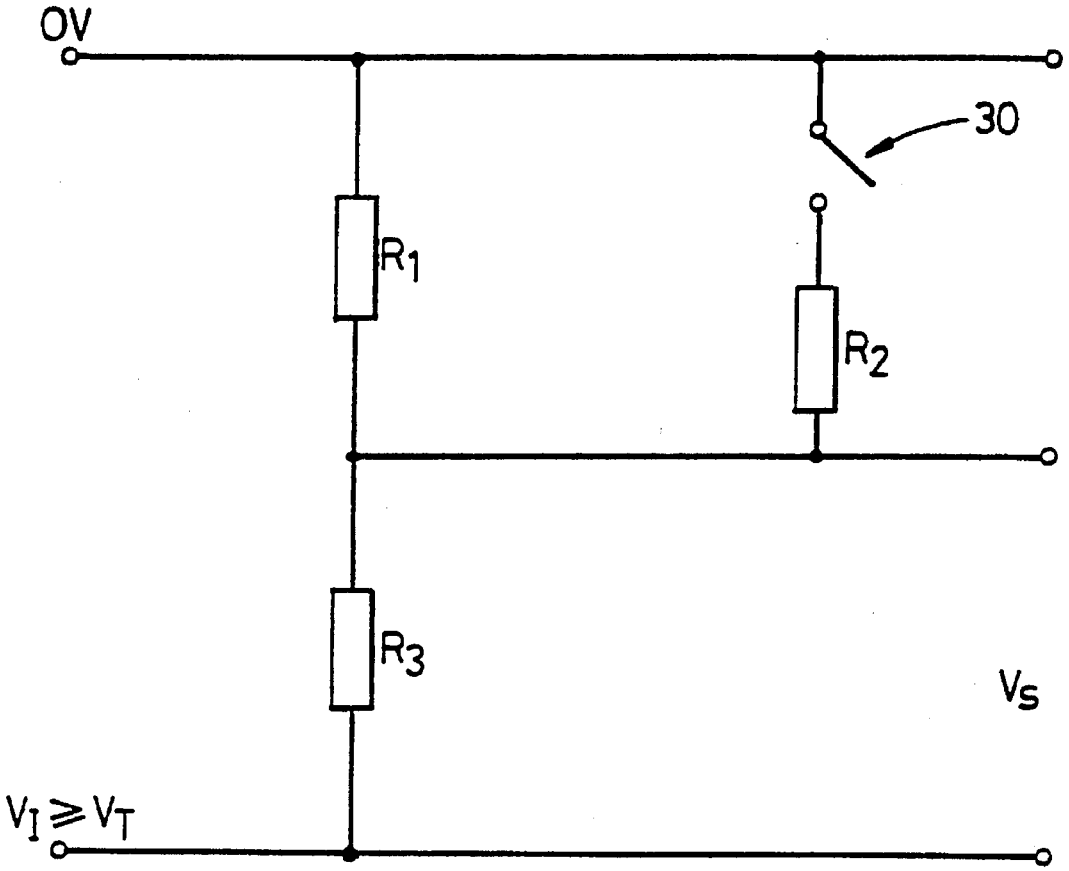
FIG. 5 is a schematic block diagram illustrating an equivalent of an electrical circuit suitable for connection between the injector nozzle and injector body for providing an output voltage signal ($V_S$) indicative of fuel injection timing.

FIG. 5 illustrates an equivalent electrical circuit for the injector body 12 and fuel nozzle 14. This circuit schematically represents the injector nozzle assembly 10 wherein the switch 30, when open, represents the needle valve member 20 in its first position and, when closed, represents the needle valve member 20 in its second position thus forming a very low resistance ($R_2$) electrical contact between the nozzle body 12 and fuel nozzle injector 14. $R_3$ delimits a current limiting resistor whilst $R_1$ represents the resistance of the separation means 16 and $R_2$ the resistance of the electrical contact formed between the injector body 12 and injector nozzle 14 via the needle valve member 20 in its second position contacting between said body 12 and nozzle 14.

It can be seen that the equivalent electrical circuit for the injector body 12 and nozzle body 14 is a simple voltage splitter circuit. The value of a detected voltage $V_S$ is dependent on the relative values of $R_1$ and $R_3$, since $R_2$ is relatively small, and whether the needle valve member 20 is in its first or second positions. A careful choice of the relative values of $R_1$ and $R_3$ allows the detected voltage $V_S$ to vary between voltage levels above and below the threshold voltage $V_T$ of the processing means to thereby provide the processing means with data indicative of needle valve member 20 lift.

The voltage output signal $V_S$ therefore provides a signal indicative of fuel injection timing and because the needle lift is rapid the signal generated is, for practical purposes, a square wave. The nature of the signal allows it to be used directly as an input to a digital electronic control unit (ECU) provided, of course, a suitable voltage is switched for example 5 volts DC. This signal therefore accurately indicates the beginning of fuel injection and the ending of fuel injection. Moreover, whilst the needle valve member 20 does take a few microseconds to move from its first position to its second position to form an electrical contact with the nozzle body 12, this time delay when compared with the period of time for which the member 20 must remain in the second position to allow fuel injection is negligible and is of no practical significance when compared to the operating time of a suitable electronic control unit.

Therefore, a very clear signal is provided indicating the start of injection which can be used as a feedback for closed loop control of injection timing.

In the case of a multi-cylinder i.c. engine, monitoring of this signal will allow an electronic control unit to individually control the timing of fuel injection into each cylinder and feedback from one timing event can be used to adjust subsequent timing events. Such information will allow an ECU to be pre-programmed to take account of feedback information in order to maintain and improve engine performance, to compensate for injector wear and highlight worn/failed components at service intervals.

The benefits of using an injector incorporating the features of the claimed invention is that closed loop control of fuel injection timing is achievable, thus eliminating the inherent differences in injection delay time between separate injectors on an engine. At 2000 revolutions per minute, for example, a 1 millisecond difference in injection delay will produce a 12° difference in injection timing, providing of course the injection signals occur at the same point before top dead center in each cylinder. If no feedback is available then the injectors have to be fired at the same point before top dead center on each cylinder. An electronic control unit being provided with feedback information regarding injector nozzle timing can "learn" the delay time for each injector on each cylinder and take account of the peculiarities inherent in every engine.

The injection signal for each cylinder can then have its timing compensated for so that each injector injects fuel at precisely the right time. The delay times that the ECU "learns" for each injector can be monitored and used as a reference. This reference value can be compared to the current operating value to save the injector from wearing to a non-acceptable level, in which case the ECU can highlight the worn injector at the following service interval. That rate of change of delay time for each injector can also be monitored to predict any possible failure in service.

The injector closed signal, generated when the needle returns to its first position thus breaking the electric circuit formed, will allow the ECU to calculate, from the injector open time, and compare the volume of fuel delivered by each injector. This will enable equal fuel volumes to be injected into each cylinder by trimming individual injector solenoid energise times.

Whilst the relative values of electrical resistance $R_1$ of the separation means 20 and the current limiting resistor $R_3$ provides a voltage signal $V_S$ indicative of fuel injection timing, it is not necessary to choose values of electrical resistance of said means 20 and resistor $R_3$ to make the voltage signal $V_S$ vary about the threshold voltage $V_T$ of the ECU. In fact, the values of $R_1$ and $R_3$ can be chosen such that the value of the voltage $V_S$ detected when the needle valve is in either of its positions is, in each case, greater than the threshold value $V_T$ of the processing means thus providing a voltage signal $V_S$ providing data in each case usable by the ECU. The ECU can be programmed to make a comparison between the value of detected voltage $V_S$ when the needle valve member 20 is in its first and its second positions respectively. The value of detected voltage $V_S$ will be greater when the needle valve member 20 is in its second position and will thus provide a signal $V_S$ indicative of fuel injection timing. However, when the needle valve member is not in its second position, a voltage signal $V_S$ of amplitude greater than the threshold voltage $V_T$ of the ECU will still be detected. This signal can be used in diagnostic tests conducted by the ECU. For example, in the case where other i.c. engine sensing means indicate a problem in fuel injection into a particular cylinder, eg. excessive temperature etc., the presence of a measurable voltage signal $V_S$ indicates that the circuitry connected across the fuel injector assembly is operating and that the fault detected by other means must relate to a malfunction in the injector assembly. The measured voltage signal $V_S$ therefore allows at least the integrity of the circuitry connected across each injector assembly to be checked on engine start-up, for example.

Whilst the separation means 16 is shown in the figures as being plain in section and positioned between the nozzle body 12 and injector nozzle 14, it will be appreciated that the nozzle body 12 and injector body 14 must be separated by any suitably shaped electrically active means 16 having electrical resistance located therebetween separating any surfaces which might normally be in contact. The separation means 16 may simply comprise a washer. It is, however, preferably formed of an electrically active film of electrically resistant material which may be spray-coated or applied by any suitable means onto appropriate surfaces of the fuel nozzle 14.

Coatings which can provide predetermined degrees of electrical resistance, wear resistance, friction resistance, chemical resistance, for example are known. One such coating is available under the registered trade name Xylan provided by the Whitford group of companies.

It will be appreciated that whilst the description of the invention relates to a fuel injector nozzle assembly for an i.c. engine, the invention can be applied to any fluid-flow control valve wherein it is necessary to determine exact timing of fluid flow through the valve opening.

We claim:

1. A fluid-flow control valve comprising juxtaposed first and second electrically conductive, stationary body members, means for separating said first and second body members, and an electrically conductive valve actuation member movably mounted to and electrically contacting said second body member, said valve actuation member being movable from a first position spaced from said first body member to a second position contacting said first body member, wherein said separating means is electrically conductive but has electrical resistance such that movement of the actuation member from its first position to its second position completes an electrical connection between said first and second body members having a lower resistance than a resistance already existing between said first and second body members through said separation means.

2. A fluid-flow control valve as claimed in claim 1, wherein the first and second body members each include electrical contact means for enabling connection thereof to an external electrical circuit.

3. A fluid-flow control valve as claimed in claim 1, wherein the valve is closed when the valve actuation member is in its first position.

4. A fluid-flow control valve as claimed in claim 3, wherein the first body member includes means for normally biasing the valve actuation member in its first position.

5. A fluid-flow control valve as claimed in claim 4, wherein an electrical contact between the biasing means and the valve actuating member has an electrical resistance greater than or equal to the electrical resistance of the electrically active separation means.

6. A fluid-flow control valve as claimed in claim 1, wherein the fluid-flow control valve is a fuel injector nozzle assembly for an internal combustion engine comprising an electrically conductive injector body mounting an electrically conductive injector nozzle, means for separating said nozzle from the body, and an electrically conductive needle vane member slidably located within the injector nozzle so as to be electrically connected therewith, said needle valve member being movable from a first position spaced from the injector body to a second position contacting the injector body, wherein the separation means is electrically conductive but has electrical resistance such that movement of the needle valve member from its first position to its second position completes an electrical connection between the body and the nozzle having a lower resistance than a resistance already existing between the body and the nozzle through the separation means.

7. A fluid-flow control valve as claimed in claim 6, wherein movement of the needle valve member from its first position to its second position is effected by an electromechanical device.

8. A fluid-flow control valve as claimed in claim 6, wherein movement of the needle valve member from its first position to its second position is caused by fuel pressure acting on the needle valve member upon a passage of fuel through the nozzle assembly.

9. A fluid-flow control valve as claimed in claim 6, wherein the injector body and nozzle are connected to an electrical circuit including a processing means, a power supply and a current limiting resistor.

10. A fluid-flow control valve as claimed in claim 9, wherein the resistance of the separation means is chosen such that a voltage detected across the current limiting resistor when the needle valve member is in its first position is less than a threshold voltage of the processing means.

11. A fluid-flow control valve as claimed in claim 9, wherein the resistance of the separation means is chosen such that a voltage detected across the current limiting resistor when the needle valve member is in its first position is greater than or equal to a threshold voltage of the processing means.

12. A fluid flow control valve comprising:

(A) juxtaposed first and second electrically conductive, stationary body members;

(C) a separation member separating said first and second body members from one another, wherein said separation member is electrically conductive but has an electrical resistance therethrough; and (D) an electrically conductive valve actuation member movably mounted in said second body member and electrically contacting said second body member, said valve actuation member being movable from a first position in which said valve actuation member is spaced from said first body member to a second position in which said valve actuation member contacts said first body member, wherein movement of said valve actuation member from said first position to said second position completes an electrical connection between said first and second body members, said electrical connection having a resistance which is lower than the resistance through said separation member.

13. A fluid-flow control valve as defined in claim 12, further comprising a biasing member which biases said valve actuation member towards said first position, said biasing member making an electrical connection with said valve actuation member which has an electrical resistance which is at least as great as the electrical resistance through said separation member.

14. A fuel injector nozzle assembly for an internal combustion engine, said nozzle assembly comprising:

(A) a stationary, electrically conductive injector body;

(B) a stationary, electrically conductive injector nozzle mounted to said injector body;

(C) a separation member separating said injector nozzle from said injector body, wherein said separation member is electrically conductive but has an electrical resistance therethrough; and (D) an electrically conductive needle valve member slidably disposed in said injector nozzle and electrically contacting said injector nozzle, said needle valve member being slidable from a first position in which said needle valve member is spaced from said injector body to a second position in which said needle valve member contacts said injector body, wherein movement of said needle valve member from said first position to said second position completes an electrical connection between said injector body and said injector nozzle, said electrical connection having a resistance which is lower than the resistance through said separation member.

15. A fuel injector nozzle assembly as defined in claim 14, further comprising an additional electrical circuit connecting said injector body to said injector nozzle, said additional electrical circuit including a processor, a power supply, and a current limiting resistor.

16. A fuel injector nozzle assembly as defined in claim 14, further comprising a plunger and spring combination which biases said needle valve member towards said first position, said combination making an electrical connection with said needle valve member, said electrical connection between said combination and said needle valve member having an electrical resistance which is at least as great as the electrical resistance of said separation member.

* * * * *